US010738261B2

(12) United States Patent
Doyen et al.

(10) Patent No.: US 10,738,261 B2
(45) Date of Patent: Aug. 11, 2020

(54) USE OF A FATTY AMINE FOR PREVENTING AND/OR REDUCING THE METAL LOSSES OF THE PARTS IN AN ENGINE

(71) Applicant: TOTAL MARKETING SERVICES, Puteaux (FR)

(72) Inventors: Valérie Doyen, Four (FR); Céline Chalancon, Saint Martin la Plaine (FR)

(73) Assignee: TOTAL MARKETING SERVICES, Puteaux (FR)

( * ) Notice: Subject to any disclaimer, the term of this patent is extended or adjusted under 35 U.S.C. 154(b) by 130 days.

(21) Appl. No.: 15/750,312

(22) PCT Filed: Aug. 3, 2016

(86) PCT No.: PCT/EP2016/068477
§ 371 (c)(1),
(2) Date: Feb. 5, 2018

(87) PCT Pub. No.: WO2017/021426
PCT Pub. Date: Feb. 9, 2017

(65) Prior Publication Data

US 2018/0223218 A1 Aug. 9, 2018

(30) Foreign Application Priority Data

Aug. 3, 2015 (FR) ..... 15 57492

(51) Int. Cl.
*C10M 149/22* (2006.01)
*C10M 133/06* (2006.01)
*C10M 133/54* (2006.01)
*C10M 169/04* (2006.01)

(52) U.S. Cl.
CPC ..... *C10M 149/22* (2013.01); *C10M 133/06* (2013.01); *C10M 133/54* (2013.01); *C10M 169/04* (2013.01); *C10M 169/041* (2013.01); *C10M 2215/04* (2013.01); *C10M 2215/26* (2013.01); *C10M 2217/046* (2013.01); *C10N 2230/12* (2013.01); *C10N 2230/52* (2013.01); *C10N 2240/102* (2013.01); *C10N 2240/104* (2013.01); *C10N 2240/105* (2013.01)

(58) Field of Classification Search
CPC ..... C10M 149/22; C10M 133/54
USPC ..... 508/556, 558, 559
See application file for complete search history.

(56) References Cited

U.S. PATENT DOCUMENTS 4,975,096 A * 12/1990 Buckley, III ..... C10L 1/2387 44/433
5,053,152 A * 10/1991 Steckel ..... C08G 73/0273 508/558
5,474,692 A * 12/1995 Laufenberg ..... C10M 105/58 508/500
5,792,730 A * 8/1998 Gutierrez ..... C10L 1/143 508/232
8,334,245 B2 * 12/2012 Lancon ..... C10M 163/00 508/554
9,605,568 B2 * 3/2017 Lancon ..... C10M 163/00
9,896,639 B2 2/2018 Lancon
2007/0214713 A1 * 9/2007 Karl ..... C10L 1/14 44/432
2011/0092403 A1 4/2011 Lancon
2014/0041610 A1 2/2014 Lancon
2016/0251590 A1 * 9/2016 Lundgren ..... C10M 133/06 508/556
2019/0040333 A1 * 2/2019 Doyen ..... C10M 133/06

FOREIGN PATENT DOCUMENTS

RU 2 352 621 C2 4/2009
RU 2 507 245 C2 2/2014
WO WO 2009/153453 A2 12/2009
WO WO 2011/042552 A1 4/2011
WO WO 2012/140215 A1 10/2012
WO WO 2014/180843 A1 11/2014
WO WO 2015/059162 A1 4/2015

OTHER PUBLICATIONS

International Search Report, dated Sep. 30, 2016, in International Application No. PCT/EP2016/068477.
Written Opinion, dated Sep. 30, 2016, in International Application No. PCT/EP2016/068477.

* cited by examiner

*Primary Examiner* — Ellen M McAvoy
(74) *Attorney, Agent, or Firm* — Knobbe, Martens, Olson & Bear, LLP

(57) ABSTRACT

One or more fatty amines are soluble in a lubricating composition for preventing and/or reducing the metal losses of the parts of an engine, such as a marine engine. The parts are brought into contact with the lubricating composition in order to prevent or reduce the metal losses.

10 Claims, No Drawings

USE OF A FATTY AMINE FOR PREVENTING AND/OR REDUCING THE METAL LOSSES OF THE PARTS IN AN ENGINE

PRIORITY AND CROSS REFERENCE TO RELATED APPLICATIONS

This application is the U.S. National Phase Application under 35 U.S.C. § 371 of International Application No. PCT/EP2016/068477, filed Aug. 3, 2016, designating the U.S. and published as WO 2017/021426 A1 on Feb. 9, 2017, which claims the benefit of French Application No. FR 1557492, filed Aug. 3, 2015.

FIELD

The present invention is related to preventing and/or reducing the metal losses of the parts in an engine.

SUMMARY

The present invention relates to the prevention and/or reduction of metallic losses of parts of an engine, in particular a marine engine. More particularly, the present invention relates to the prevention and/or reduction of metallic losses of parts of a marine engine due to the contact of these parts with an acid medium.

The present invention relates to the use of one or more soluble fatty amines in a lubricant composition for preventing and/or reducing the metallic losses of parts of an engine, in particular a marine engine.

The present invention also relates to a method for preventing and/or reducing the metallic losses of the parts of an engine, in particular a marine engine, wherein the said parts are brought into contact with one or more soluble fatty amines in a lubricating composition.

DETAILED DESCRIPTION

The combustion of fuel oils generates acid gases, in particular sulfur oxides ($SO_2$, $SO_3$). These acid gases are, among other things, combustion residues of the fuel oils; these residues are in contact with the lubricating oil, and therefore are also in contact with the engine parts. Upon contact with the moisture present in the combustion gases and/or in the lubricating oil, these acid gases hydrolyze to *sulphurous* acid ($HSO_3$) or sulfuric acid ($H_2SO_4$), which are in turn in contact with the parts of the engine.

In the case of marine engines, especially two-stroke marine engines, lubricating oils are classified into two categories: cylinder oils, on the one hand, ensuring lubrication of the cylinder piston assembly, and system oils, on the other hand, ensuring lubrication of all moving parts other than those of the cylinder piston assembly. More specifically, it is within the cylinder piston assembly that the combustion residues containing acid gases are in contact with the lubricating oil.

In general, the neutralization of these acids is carried out by reaction with the basic sites included in the lubricant. The capacity of neutralization of an oil is measured by its Base Number (BN), characterizing its basicity. It is measured according to the standard ASTM D-2896 and is expressed in equivalent weight of potash per gram of oil or mg of KOH/g of oil. BN is a classic criterion for adjusting the basicity of cylinder oils to the sulfur content of the fuel used, in order to neutralize all the sulfur contained in the fuel, and likely to be converted into sulfuric acid by combustion and hydrolysis.

More specifically, marine oils available on the market have a BN ranging from 5 to 130 mg KOH/g of oil. This basicity is, in particular, provided by detergents which are overbased by insoluble metal salts, in particular, metal carbonates. The detergents, mainly of the anionic type, are, for example, metal salicylate, phenate, sulphonate or carboxylate soaps which form micelles in which the insoluble metal salt particles are kept in suspension. The usual overbased detergents intrinsically have a BN conventionally comprised between 150 and 700 mg of potash per gram of detergent.

Part of the BN may also be provided by non-overbased or "neutral" detergents of BN typically less than 150 mg of potash per gram of detergent.

Nevertheless, the Applicant has found that during the combustion of fuel oil, the neutral and/or overbased detergents present in the lubricant composition deteriorated chemically and therefore formed ash, also called residues or deposits which favored the fouling of the engine, in particular the marine engine.

In order to reduce the ash content formed during the combustion of fuel oil, the Applicant replaced part of the detergents supplying the entire BN of the lubricating composition with compounds providing BN and forming no or little ash during the combustion of fuel oil. The Applicant has therefore developed lubricating compositions in which a portion of the detergents providing the BN of the lubricating composition is replaced by amino compounds.

WO 2009/153453 discloses a lubricating composition for cylinders having a BN greater than or equal to 40 milligrams of potash per gram of lubricant and comprising a base oil, a detergent based on alkali metals or alkaline earth, overbased by metal salts of carbonate, a neutral detergent and a fatty amine and/or oil-soluble fatty amine derivative having a BN of between 150 and 600 milligrams of potash per gram of lubricant.

WO 2014/180843 discloses a lubricating composition for a cylinder having a BN greater than or equal to 50 milligrams of potash per gram of lubricant comprising a base oil, a detergent based on alkaline or alkaline earth metals, overbased by metal salts of carbonate, a neutral detergent and a fatty amine mixture having four amine units.

EP 2 486 113 discloses a marine engine lubricating oil comprising a monoamine comprising a base oil, a detergent and a mono-disubstituted monoamine of a hydrogen atom or a hydrocarbon group having 1 to 50 carbon atoms.

In the continuity of its investigations, the Applicant has surprisingly discovered that the amine compounds, usually used to replace part of the BN of the lubricating composition while decreasing the ash content formed during the combustion of fuel oil, also make it possible to prevent and/or to reduce the metallic losses of the parts of an engine, in particular of a marine engine, when these are in contact with acids resulting from the combustion of fuel oil.

Thus, the Applicant company has found that the use of one or more fatty amines soluble in a lubricating composition, wherein the fatty amine is chosen from among:

the compounds of formula (I):

$$R_1—[(NR_2)—R_3]_m—NR_4R_5,$$

wherein, $R_1$ represents a saturated or unsaturated hydrocarbon group, linear or branched, comprising at least 12 carbon atoms, and optionally at least one heteroatom chosen from among nitrogen, sulfur or oxygen, $R_2$, $R_4$ or $R_5$ independently represent a hydrogen atom or a saturated or unsaturated hydrocarbon group, linear or branched, and optionally comprising at least one heteroatom chosen from among nitrogen, sulfur or oxygen, $R_3$ represents a saturated or unsaturated hydrocarbon group, linear or branched, comprising one or more carbon atoms, and optionally comprising at least one heteroatom selected from among nitrogen, sulfur or oxygen, preferably oxygen;

m is an integer greater than or equal to 1, preferably between 1 and 10, more preferably between 1 and 6, even more preferably chosen from among 1, 2 or 3, or a mixture of fatty polyalkylamines comprising one or more polyalkylamines of formulas (III) and/or (IV):

(III)

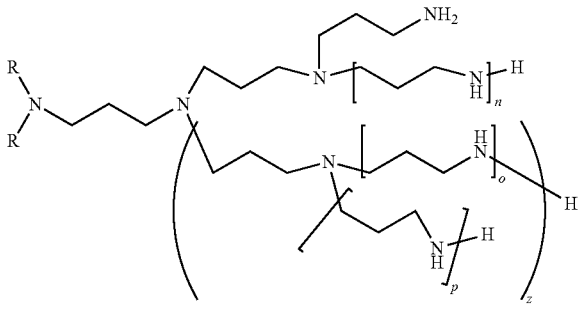

(IV)

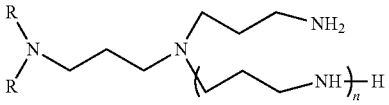

wherein

R, identical or different, represents a linear or branched alkyl group comprising from 8 to 22 carbon atoms, n and z, independently of each other, represent 0, 1, 2 or 3, and o and p, independently of each other, represent 0, 1, 2 or 3 when z is greater than 0, wherein the said mixture comprises at least 3% by weight of branched compounds so that at least one of n or z is greater than or equal to 1, or derivatives thereof, or mixtures of fatty amines of formulas (I), (III) and/or (IV), prevent and/or reduce the metallic losses of the parts of an engine, preferably of a marine engine.

Fatty amines of formula (I) included in a lubricating composition are known per se in the applications WO 2009/153453 and WO 2014/180843 filed by the Applicant. The Applicant has now discovered a new use of these fatty amines.

A first object of the invention relates to the use of one or more soluble fatty amines in a lubricating composition for preventing and/or reducing the metallic losses of parts of an engine, preferably of a marine engine, wherein the fatty amine is chosen from among:

the compounds of formula (I):

$$R_1—[(NR_2)—R_3]_m—NR_4R_5,$$

wherein, $R_1$ represents a saturated or unsaturated hydrocarbon group, linear or branched, comprising at least 12 carbon atoms, and optionally at least one heteroatom chosen from nitrogen, sulfur or oxygen, $R_2$, $R_4$ or $R_5$ independently represent a hydrogen atom or a saturated or unsaturated hydrocarbon group, linear or branched, and optionally comprises at least one heteroatom chosen from among nitrogen, sulfur or oxygen, $R_3$ represents a saturated or unsaturated hydrocarbon group, linear or branched, comprising one or more carbon atoms, and optionally comprising at least one heteroatom selected from among nitrogen, sulfur or oxygen, preferably oxygen;

m is an integer greater than or equal to 1, preferably between 1 and 10, more preferably between 1 and 6, still more preferably is selected from among 1, 2 or 3; or a mixture of di-alkyl fatty polyalkylamines comprising one or more polyalkylamines of formulas (III) and/or (IV):

(III)

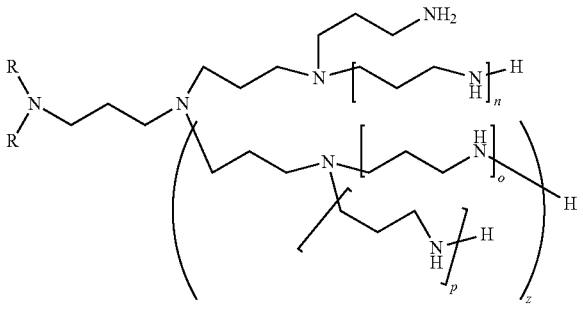

(IV)

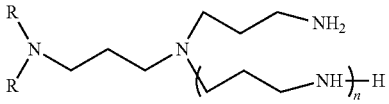

wherein:

R, identical or different, represents a linear or branched alkyl group comprising from 8 to 22 carbon atoms, n and z represent, independently of one another, 0, 1, 2 or 3, and o and p represent, independently of one another, 0, 1, 2 or 3 when z is greater than 0, wherein the said mixture comprises at least 3% by weight of branched compounds so that at least one of n or z is greater than or equal to 1, or of their derivatives; or a mixture of fatty amines of formulas (I), (III) and/or (IV).

Without being bound to the theory, the Applicant has observed, surprisingly, that the fatty amines according to the invention make it possible not only to bring organic BN to the lubricating composition while providing no or little ash during the combustion of fuel oil but also prevent and/or reduce the metal losses of parts of an engine, especially in a marine engine, when they are brought into contact with the acids from the combustion of fuel oil. More specifically, the Applicant has unexpectedly discovered that these fatty amines that are soluble in a lubricating composition in the presence of a large excess of sulfuric acid, make it possible to prevent and/or reduce the metallic losses of the parts directly in contact with said lubricating composition and the large excess of sulfuric acid. This limitation and/or reduction of the metallic losses of the parts is probably due to the passivation of all or part of the surface of the metal parts by the said fatty amines.

For the purposes of the invention, the term "metallic losses of the parts of an engine" means the metallic losses resulting from the attack of these parts by the acids and not the metal losses generated by friction of one metal part on a other.

Preferably, when the fatty amine is of formula (I):

$R_1$ represents a linear or branched, saturated or unsaturated alkyl group comprising from 12 to 22 carbon atoms, preferably from 14 to 22 carbon atoms, and optionally at least one heteroatom chosen from among nitrogen, sulfur or oxygen, and/or $R_2$, $R_4$ or $R_5$ independently represent a hydrogen atom; a saturated or unsaturated, linear or branched alkyl group comprising between 1 and 22 carbon atoms, preferably between 14 and 22 carbon atoms, more preferably between 16 and 22 carbon atoms; or a $(R_6—O)_q—H$ group in which $R_6$ is a saturated, linear or branched alkyl group comprising at least 2 carbon atoms, preferably between 2 and 6 carbon atoms, more preferably between 2 and 4 carbon atoms, and q represents an integer greater than or equal to 1, preferably between 1 and 6, more preferably between 1 and 4, and/or $R_3$ represents a linear or branched, saturated or unsaturated alkyl group comprising between 2 and 6 carbon atoms, preferably between 2 and 4 carbon atoms.

More preferentially, when the fatty amine is of formula (I):

m is 1, 2 or 3, $R_1$ represents a saturated or unsaturated, linear or branched alkyl group comprising from 12 to 20 carbon atoms, preferably from 14 to 20 carbon atoms, and optionally at least one heteroatom chosen from among nitrogen, sulfur or oxygen, $R_2$ independently represents a hydrogen atom or a saturated, linear or branched alkyl group comprising from 1 to 20 carbon atoms, preferably from 16 to 20 carbon atoms, more preferably from 16 to 18 carbon atoms, $R_3$ represents a saturated and linear alkyl group comprising between 2 and 6 carbon atoms, preferably between 2 and 4 carbon atoms, $R_4$ and $R_5$ represent a hydrogen atom or a methyl group, preferably a hydrogen atom.

Advantageously, when the fatty amine is of formula (I):

m is equal to 3, $R_1$ represents a saturated or unsaturated, linear or branched alkyl group comprising from 12 to 20 carbon atoms, preferably from 14 to 20 carbon atoms, more preferably from 16 to 20 carbon atoms, and optionally at least one heteroatom selected from among nitrogen, sulfur or oxygen, $R_2$ independently represents a hydrogen atom or a linear or branched, saturated alkyl group comprising from 16 to 18 carbon atoms, $R_3$ represents an ethyl or propyl group, $R_4$ and $R_5$ represent a hydrogen atom.

More preferentially, when the fatty amine is also of formula (I):

m is equal to 1, 2 or 3,

R1 represents a linear or branched, saturated or unsaturated alkyl group comprising from 14 to 20 carbon atoms, preferably from 16 to 20 carbon atoms, $R_2$, $R_4$ or $R_5$ independently represent a hydrogen atom or an $(R_6—O)_q—H$ group in which $R_6$ is a linear saturated alkyl group comprising between 2 and 6 carbon atoms, more preferably between 2 and 4 carbon atoms and q represents an integer between 1 and 6, more preferably between 1 and 4, $R_3$ represents a saturated and linear alkyl group, comprising between 2 and 6 carbon atoms, preferably between 2 and 4 carbon atoms.

Advantageously, when the fatty amine is also of formula (I):

m is equal to 3, $R_1$ represents a linear or branched, saturated or unsaturated alkyl group comprising from 14 to 20 carbon atoms, preferably from 16 to 20 carbon atoms, $R_2$, $R_4$ or $R_5$ independently represent a hydrogen atom or an $(R_6—O)_q—H$ group in which $R_6$ is a linear saturated alkyl group comprising between 2 and 4 carbon atoms and q represents an integer between 1 and 4, $R_3$ represents an ethyl or propyl group.

According to a particular embodiment of the invention, the use of fatty amine of formulas (I), (III) and/or (IV) makes it possible to prevent and/or reduce the metallic losses of parts in a 2-stroke or 4-stroke marine engine, when burning any type of fuel oil.

Preferably, the use of fatty amine of formulas (I), (III) and/or (IV) makes it possible to prevent and/or reduce the metallic losses of the parts in the hot regions, in particular the piston-ring jacket zone of a 2-stroke or 4-stroke marine engine, when burning any type of fuel oil.

Preferably, the fuel oil has a sulfur content of less than 3.5% by weight relative to the total weight of the fuel oil.

DETAILED DESCRIPTION OF THE INVENTION

Fatty Amine

An object of the invention relates to the use of one or more soluble fatty amines in a lubricating composition for preventing and/or reducing the metallic losses of parts of an engine, preferably of a marine engine, wherein the fatty amine is chosen from among:

the compounds of formula (I):

$$R_1—[(NR_2)—R_3]_m—NR_4R_5,$$

wherein, $R_1$ represents a saturated or unsaturated hydrocarbon group, linear or branched, comprising at least 12 carbon atoms, and optionally at least one heteroatom chosen from among nitrogen, sulfur or oxygen, $R_2$, $R_4$ or $R_5$ independently represent a hydrogen atom or a saturated or unsaturated hydrocarbon group, linear or branched, and optionally comprising at least one heteroatom chosen from among nitrogen, sulfur or oxygen, $R_3$ represents a saturated or unsaturated hydrocarbon group, linear or branched, comprising one or more carbon atoms, and optionally comprising at least one heteroatom selected from among nitrogen, sulfur or oxygen, preferably oxygen;

m is an integer greater than or equal to 1, preferably between 1 and 10, more preferably between 1 and 6, still more preferably is selected from 1, 2 or 3; or a mixture of di-alkyl fatty polyalkylamines comprising one or more polyalkylamines of formulas (III) and/or (IV):

(III)

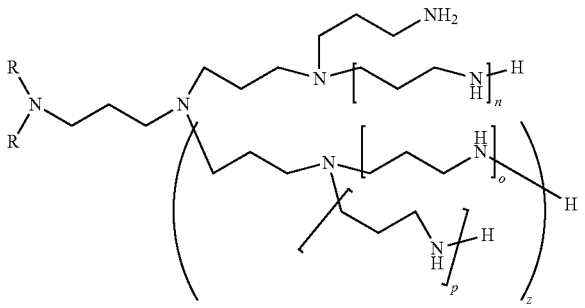

(IV)

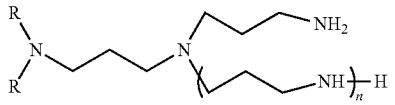

wherein:

R, identical or different, represents a linear or branched alkyl group comprising from 8 to 22 carbon atoms, n and z represent, independently of one another, 0, 1, 2 or 3, and o and p represent, independently of one another, 0, 1, 2 or 3 when z is greater than 0, wherein the said mixture comprises at least 3% by weight of branched compounds so that at least one of n or z is greater than or equal to 1, or of their derivatives; or a mixture of fatty amines of formulas (I), (III) and/or (IV).

Preferably, another object of the invention relates to the use of one or more soluble fatty amines in a lubricating composition for preventing and/or reducing the metallic losses of parts of an engine, preferably of a marine engine, wherein the fatty amine is of formula (I):

$$R_1—[(NR_2)—R_3]_m—NR_4R_5,$$

wherein, $R_1$ represents a saturated or unsaturated hydrocarbon group, linear or branched, comprising at least 12 carbon atoms, and optionally at least one heteroatom chosen from among nitrogen, sulfur or oxygen, $R_2$, $R_4$ or $R_5$ independently represent a hydrogen atom or a saturated or unsaturated hydrocarbon group, linear or branched, and optionally comprising at least one heteroatom chosen from among nitrogen, sulfur or oxygen, $R_3$ represents a saturated or unsaturated hydrocarbon group, linear or branched, comprising one or more carbon atoms, and optionally comprising at least one heteroatom selected from among nitrogen, sulfur or oxygen, preferably oxygen;

m is an integer greater than or equal to 1, preferably between 1 and 10, more preferably between 1 and 6, still more preferably selected from among 1, 2 or 3.

Preferably, another object of the invention relates to the use of one or more soluble fatty amines in a lubricating composition for preventing and/or reducing the metallic losses of parts of an engine, preferably of a marine engine, wherein the fatty amine is a mixture of fatty polyalkylamines comprising one or more polyalkylamines of formulas (III) and/or (IV):

(III)

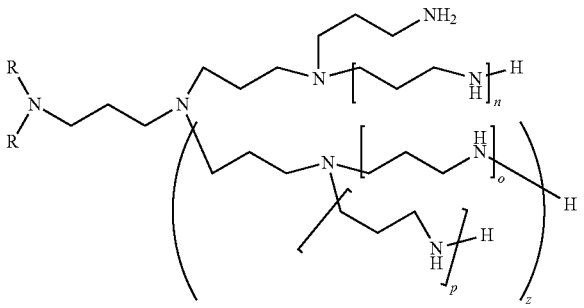

(IV)

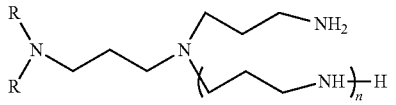

wherein:

R, identical or different, represents a linear or branched alkyl group comprising from 8 to 22 carbon atoms, n and z represent, independently of one another, 0, 1, 2 or 3, and o and p represent, independently of one another, 0, 1, 2 or 3 when z is greater than 0, wherein the said mixture comprises at least 3% by weight of branched compounds so that at least one of n or z is greater than or equal to 1, or of their derivatives.

The term "fatty amine" according to the invention is understood to mean an amine of formula (I), (III) or (IV) comprising one or more hydrocarbon groups, saturated or unsaturated, linear or branched, and optionally comprising at least one heteroatom chosen from among nitrogen, sulfur or oxygen, preferably oxygen.

By "several fatty amines" according to the invention is meant a mixture of fatty amines of which at least one fatty amine is of formulas (I), (III) and/or (IV).

Preferably, when the fatty amine is of formula (I):

$R_1$ represents a linear or branched, saturated or unsaturated alkyl group comprising from 12 to 22 carbon atoms, preferably from 14 to 22 carbon atoms, and optionally at least one heteroatom chosen from among nitrogen, sulfur or oxygen, and/or $R_2$, $R_4$ or $R_5$ independently represent a hydrogen atom; a saturated or unsaturated, linear or branched alkyl group comprising between 1 and 22 carbon atoms, preferably between 14 and 22 carbon atoms, more preferably between 16 and 22 carbon atoms; or an $(R_6—O)_q—H$ group in which $R_6$ is a saturated, linear or branched alkyl group comprising at least 2 carbon atoms, preferably between 2 and 6 carbon atoms, more preferably between 2 and 4 carbon atoms, and q represents an integer greater than or equal to 1, preferably between 1 and 6, more preferably between 1 and 4, and/or $R_3$ represents a linear or branched, saturated or unsaturated alkyl group comprising between 2 and 6 carbon atoms, preferably between 2 and 4 carbon atoms.

Advantageously, when the fatty amine is of formula (I):

m is equal to 1, 2 or 3, $R_1$ represents a linear or branched, saturated or unsaturated alkyl group comprising from 14 to 20 carbon atoms, preferably from 16 to 20 carbon atoms, and optionally at least one heteroatom chosen from among nitrogen, sulfur or oxygen, $R_2$ independently represents a hydrogen atom or a saturated, linear or branched alkyl group comprising from 1 to 20 carbon atoms, more preferably from 16 to 20 carbon atoms, even more preferably from 16 to 18 carbon atoms, $R_3$ represents a saturated and linear alkyl group comprising between 2 and 6 carbon atoms, preferably between 2 and 4 carbon atoms, $R_4$ and $R_5$ represent a hydrogen atom or a methyl group, preferably a hydrogen atom.

In particular, when the fatty amine is of formula (I):

m is equal to 3, $R_1$ represents a linear or branched, saturated or unsaturated alkyl group comprising from 14 to 20 carbon atoms, preferably from 16 to 20 carbon atoms, and optionally at least one heteroatom chosen from among nitrogen, sulfur or oxygen, $R_2$ independently represents a hydrogen atom or a linear or branched, saturated alkyl group comprising from 16 to 18 carbon atoms, $R_3$ represents an ethyl or propyl group, $R_4$ and $R_5$ represent a hydrogen atom.

Advantageously, when the fatty amine is of formula (I):

m is equal to 1, 2 or 3,

R1 represents a linear or branched, saturated or unsaturated alkyl group comprising from 14 to 20 carbon atoms, preferably from 16 to 20 carbon atoms, $R_2$, $R_4$ or $R_5$ independently represent a hydrogen atom or an $(R_6—O)_q—H$ group in which $R_6$ is a linear saturated alkyl group comprising between 2 and 6 carbon atoms, more preferably between 2 and 4 carbon atoms; and q represents an integer between 1 and 6, more preferably between 1 and 4, $R_3$ represents a saturated and linear alkyl group, comprising between 2 and 6 carbon atoms, preferably between 2 and 4 carbon atoms.

In particular, when the fatty amine is of formula (I):

m is equal to 3, $R_1$ represents a linear or branched, saturated or unsaturated alkyl group comprising from 14 to 20 carbon atoms, preferably from 16 to 20 carbon atoms, $R_2$, $R_4$ or $R_5$ independently represent a hydrogen atom or an $(R_6—O)_q—H$ group in which $R_6$ is a linear saturated alkyl group comprising between 2 and 4 carbon atoms and q represents an integer between 1 and 4, $R_3$ represents an ethyl or propyl group.

In general, the fatty amines of formula (I) according to the invention are mainly obtained from carboxylic acids. These acids are dehydrated in the presence of ammonia to give nitriles, and then undergo catalytic hydrogenation to lead in particular to fatty amines.

Within the meaning of the invention, the fatty amine of formula (I) is obtained from at least one carboxylic acid, preferably at least one fatty acid.

Within the meaning of the invention, the alkyl group of the fatty amine of formula (I) has a number of carbon atoms corresponding to the number of carbon atoms of the carbon chain of the carboxylic acid, preferably corresponding to the number of carbon atoms of the carbon chain of the fatty acid.

Within the meaning of the invention, a same fatty amine of formula (I) may be substituted with several alkyl groups obtained from several identical or different carboxylic acids, preferably obtained from several identical or different fatty acids.

According to a particular embodiment of the invention, the alkyl group is obtained from fatty acid chosen from among caprylic, pelargonic, capric, undecylenic, lauric, tridecylenic, myristic, pentadecyl, palmitic, margaric, stearic, nonadecyl, arachic, henicosanoic, behenic, tricosanoic, lignoceric, pentacosanoic, cerotic, heptacosanoic, montanic, nonacosanoic, melissic, hentriacontanoic, laceroic, and their derivatives or unsaturated fatty acids such as palmitoleic, oleic, erucic, nervonic, linoleic, a-linolenic, c-linolenic, dihomo-c-linolenic, arachidonic, eicosapentaenoic, docosahexanoic, and their derivatives.

Preferably, the fatty acids are derived from the hydrolysis of triglycerides present in vegetable and animal oils, such as coconut oil, palm oil, olive oil, peanut oil, rapeseed oil, sunflower oil, soya oil, of cotton, flax, beef tallow. Natural oils may have been genetically modified to enrich their content of certain fatty acids, for example rapeseed oil or oleic sunflower oil.

In general, the fatty amine of formula (I) according to the invention is preferably obtained from natural resources, plant or animal. Treatments for producing fatty amines from natural oils may lead to mixtures of primary, secondary and tertiary polyamines.

According to a particular embodiment of the invention, when several fatty amines of formula (I) are used to prevent and/or reduce the metallic losses of the parts of an engine, the said fatty amines form a mixture of fatty amines comprising, in particular, variable proportions, which are all or part of the compounds corresponding to the following formulas (Ia), (Ib) and (Ic):

$$R_1—[(NR_2)—R_3]—NR_4R_5 \quad \text{(Ia)},$$

$$R_1—[(NR_2)—R_3]_2—NR_4R_5 \quad \text{(Ib)},$$

$$R_1—[(NR_2)—R_3]_3—NR_4R_5 \quad \text{(Ic)}$$

wherein, $R_1$ represents a saturated or unsaturated hydrocarbon group, linear or branched, comprising at least 12 carbon atoms, and optionally at least one heteroatom chosen from among nitrogen, sulfur or oxygen, $R_2$, $R_4$ or $R_5$ independently represent a hydrogen atom or a saturated or unsaturated hydrocarbon group, linear or branched, and optionally comprise at least one heteroatom chosen from among nitrogen, sulfur or oxygen, $R_3$ represents a saturated or unsaturated hydrocarbon group, linear or branched, comprising one or more carbon atoms and optionally comprising at least one heteroatom selected from among nitrogen, sulfur or oxygen, preferably oxygen.

The preferences and advantages for the definitions of the groups $R_1$, $R_2$, R3, $R_4$, $R_5$ and $R_6$ of the fatty amines of formulas (Ia), (Ib) and (Ic) are as defined above for the fatty amine of formula (I) according to the invention.

According to another particular embodiment, the mixture of fatty amines of formula (I) is in a purified form, i.e. it comprises mainly a single type of amine of formula (Ia), (Ib) or (Ic), for example predominantly diamines of formula (Ia), triamines of formula (Ib) or predominantly tetramines of formula (Ic). In particular, the mixture of fatty amines comprises predominantly tetramines of formula (Ic).

According to a particular embodiment of the invention, the mixture of fatty amines of formula (I) mainly comprises:

diamines of formula (Ia), or triamines of formula (Ib), or tetramines of formula (Ic), wherein, the groups $R_1$, $R_2$, $R_3$, $R_4$, $R_5$ and $R_6$ are as defined above.

In another embodiment of the invention, the mixture of fatty amines of formula (I) mainly comprises diamines of formula (Ia) in which:

$R_1$ represents a saturated or unsaturated, linear or branched alkyl group comprising from 12 to 20 carbon atoms, preferably from 14 to 20 carbon atoms, more preferably from 16 to 20 carbon atoms, $R_2$ represents a saturated, linear or branched alkyl group comprising from 1 to 5 carbon atoms, preferably from 1 to 3 carbon atoms, more preferably a methyl group, $R_3$ represents an ethyl or propyl group, $R_4$ and $R_5$ independently represent a saturated, linear or branched alkyl group comprising from 1 to 5 carbon atoms, preferably from 1 to 3 carbon atoms, more preferably a methyl group.

Preferably, the mixture of fatty amines of formula (I) mainly comprises diamines of formula $R_1$—[($NR_2$)—$R_3$]—$NH_2$ (IIa), triamines of formula $R_1$—[($NR_2$)—$R_3$]$_2$—$NH_2$ (IIb), or tetramines of formula $R_1$—[($NR_2$)—$R_3$]$_3$—$NH_2$ (IIc), wherein:

$R_1$ or $R_2$ represents at least one alkyl group, saturated or unsaturated, obtained from a fatty acid derived from tallow fat, or soybean oil, or coconut oil, or from sunflower oil (oleic), and $R_3$ represents a saturated or unsaturated hydrocarbon group, linear or branched, comprising at least 2 carbon atoms.

For the purpose of the invention, when $R_1$ or $R_2$ represents a saturated alkyl group, the said saturated alkyl is obtained from a saturated fatty acid or from a hydrogenated unsaturated fatty acid, in particular from the whole of these double bonds.

Advantageously, the mixture of fatty amines of formula (I) comprising predominantly tetramines of formula $R_1$—[($NR_2$)—$R_3$]$_3$—$NH_2$ (IIc) is in the form:

of at least one fatty amine of formula (IIc) in which $R_1$ represents a saturated or unsaturated, linear or branched alkyl group comprising from 14 to 16 carbon atoms; $R_2$ represents a hydrogen atom; and $R_3$ represents a linear saturated alkyl group comprising from 2 to 6 carbon atoms, of at least one fatty amine of formula (IIc) in which $R_1$ represents a saturated or unsaturated, linear or branched alkyl group comprising at least 18 carbon atoms; $R_2$ represents a hydrogen atom; and $R_3$ represents a linear saturated alkyl group comprising from 2 to 6 carbon atoms, and at least one fatty amine of formula (IIc) in which $R_1$ represents a saturated or unsaturated, linear or branched alkyl group comprising at least 20 carbon atoms; $R_2$ represents a hydrogen atom; and $R_3$ represents a linear saturated alkyl group comprising from 2 to 6 carbon atoms.

In particular, the mixture of fatty amines of formula (I) comprising predominantly tetramines of formula $R_1$—[($NR_2$)—$R_3$]$_3$—$NH_2$ (IIc) is in the form:

of at least one fatty amine of formula (IIc) in which $R_1$ represents a saturated or unsaturated, linear or branched alkyl group comprising from 14 to 16 carbon atoms; $R_2$ represents a hydrogen atom; and $R_3$ represents a linear saturated alkyl group comprising from 2 to 6 carbon atoms, of at least one fatty amine of formula (IIc) in which $R_1$ represents a saturated or unsaturated, linear or branched alkyl group comprising at least 18 carbon atoms; $R_2$ represents a hydrogen atom; and $R_3$ represents a linear saturated alkyl group comprising from 2 to 6 carbon atoms, and of at least one fatty amine of formula (IIc) in which $R_1$ represents a saturated or unsaturated, linear or branched alkyl group comprising at least 20 carbon atoms; $R_2$ represents a hydrogen atom; and $R_3$ represents a linear saturated alkyl group comprising from 2 to 6 carbon atoms, the sum of the weight content of the said fatty amines of formula (IIc) is greater than 90% relative to the weight of the said mixture of fatty amines.

Advantageously, the mixture of fatty amines of formula (I) comprising predominantly tetramines of formula $R_1$—[($NR_2$)—$R_3$]$_3$—$NH_2$ (IIc) is also in the form:

of at least one fatty amine of formula (IIc) in which $R_1$ represents a linear or branched unsaturated alkyl group comprising from 16 to 20 carbon atoms, preferably from 18 to 20 carbon atoms; $R_2$ represents a hydrogen atom; and $R_3$ represents a linear saturated alkyl group comprising from 2 to 6 carbon atoms and of at least one fatty amine of formula (IIc) in which $R_1$ represents a linear or branched saturated alkyl group comprising from 16 to 20 carbon atoms, preferably from 18 to 20 carbon atoms; $R_2$ represents a hydrogen atom; and $R_3$ represents a linear saturated alkyl group comprising from 2 to 6 carbon atoms.

In particular, the mixture of fatty amines of formula (I) comprising predominantly tetramines of formula $R_1$—[($NR_2$)—$R_3$]$_3$—$NH_2$ (IIc) is in the form:

of at least one fatty amine of formula (IIc) in which $R_1$ represents a linear or branched unsaturated alkyl group comprising from 16 to 20 carbon atoms, preferably from 18 to 20 carbon atoms; $R_2$ represents a hydrogen atom; and $R_3$ represents a linear saturated alkyl group comprising from 2 to 6 carbon atoms, of at least one fatty amine of formula (IIc) in which $R_1$ represents a linear or branched saturated alkyl group comprising from 16 to 20 carbon atoms, preferably from 18 to 20 carbon atoms; $R_2$ represents a hydrogen atom; and $R_3$ represents a linear saturated alkyl group comprising from 2 to 6 carbon atoms, the sum of the weight content of the said fatty amines of formula (IIc) being greater than 90% relative to the weight of the said mixture of fatty amines.

Preferably, the fatty amine mixture of formula (I) does not comprise fatty amines other than fatty amines corresponding to formula (IIc).

According to one particular embodiment of the invention, when a single fatty amine of formula (I) is used to prevent and/or reduce the metallic losses of the parts of an engine, the said fatty amine corresponds to one of the following formulas:

a diamine of formula (IIa), or a triamine of formula (IIb), or a tetramine of formula (IIc), in which, $R_1$ represents a linear or branched saturated hydrocarbon group comprising at least 14 carbon atoms, $R_2$ independently represents a hydrogen atom or a saturated hydrocarbon group, linear or branched, comprising at least 14 carbon atoms, $R_3$ represents a linear saturated hydrocarbon group comprising at least 2 carbon atoms.

In this embodiment, the fatty amine of formula (I) is preferably a tetramine of formula (IIc) in which, $R_1$ represents a linear or branched saturated alkyl group comprising between 14 and 18 carbon atoms, $R_2$ independently represents a hydrogen atom or a saturated hydrocarbon group, linear or branched, comprising between 14 and 18 carbon atoms, $R_3$ represents a saturated hydrocarbon group, linear, comprising between 2 and 6 carbon atoms.

In this embodiment, the fatty amine of formula (I) is advantageously a tetramine of formula (IIc) in which, $R_1$ represents a linear or branched saturated alkyl group comprising between 16 and 18 carbon atoms, $R_2$ independently represents a hydrogen atom or a saturated hydrocarbon group, linear or branched, comprising between 16 and 18 carbon atoms, $R_3$ represents an ethyl or propyl group.

Preferably, when the fatty amine is a mixture of polyalkylamines of formulas (III) and/or (IV), the polyalkylamine mixtures comprise at least 5% by weight of compounds having a pure linear structure, since these compounds have been shown to have an acceptable viscosity profile.

According to one embodiment, when the fatty amine is a mixture of polyalkylamines of formulas (III) and/or (IV), the polyalkylamine mixtures comprise at least 4% by weight (% m/m), preferably at least 5% m/m, preferably at least 6% m/m, preferably more than 7% m/m, preferably more than 7.5% m/m, preferably more than 10% m/m, more preferably 20% m/m of branched compounds of which at least one of n or z is greater than or equal to 1.

For the products of formula (III), this means that for the branched products, n must be greater than or equal to 1.

Preferably, when the fatty amine is a mixture of polyalkylamines of formulas (III) and/or (IV), when n, o, p or z is equal to 0, the hydrogen atom present at the end of the chain is covalently bonded to the corresponding secondary nitrogen atom.

Preferably, when the fatty amine is a mixture of polyalkylamines of formulas (III) and/or (IV), the mixture comprises compounds of formulas (III) and/or (IV) in which n, o, p and z when they are different from 0, they are equal to 1 or 2, preferably when n, o, p and z are different from 0, they are equal to 1.

According to a preferred embodiment, when the fatty amine is a mixture of polyalkylamines of formulas (III) and/or (IV), the mixture essentially comprises compounds of formulas (III) and/or (IV) for which n, o, p or z are independently 0, 1 or 2, preferably n, o, p or z are independently 0 or 1.

According to a preferred embodiment, when the fatty amine is a mixture of polyalkylamines of formulas (III) and/or (IV), the mixture essentially comprises compounds of formulas (III) and/or (IV) and their derivatives, wherein n, o, p and z are independently 0, 1 or 2, preferably n, o, p and z are independently 0 or 1.

The derivatives of the compounds of formulas (III) and/or (IV) are described below.

According to a preferred embodiment, each R group is, independently of one another, a linear or branched alkyl group comprising from 14 to 22 carbon atoms, preferably from 14 to 20 carbon atoms, more preferably from 16 to 20 carbon atoms.

In general, the fatty amines of formula (III) and (IV) according to the invention are mainly obtained from carboxylic acids. These acids are dehydrated in the presence of ammonia to give nitriles, and then undergo catalytic hydrogenation to lead in particular to fatty amines.

Within the meaning of the invention, the fatty amines of formula (III) and (IV) are obtained from at least one carboxylic acid, preferably at least one fatty acid.

Within the meaning of the invention, the alkyl group of the fatty amines of formula (III) and (IV) has a number of carbon atoms corresponding to the number of carbon atoms of the carbon chain of the carboxylic acid, preferably corresponding to the number of carbon atoms of the carbon chain of the fatty acid.

Within the meaning of the invention, the same fatty amine of formula (I) may be substituted with several alkyl groups obtained from several identical or different carboxylic acids, preferably obtained from several identical or different fatty acids.

Within the meaning of the invention, the same fatty amine of formula (I) may be substituted with several alkyl groups obtained from several identical or different carboxylic acids, preferably obtained from several identical or different fatty acids.

Although the two R groups may be different, they are, according to a preferred embodiment, identical, such compounds being produced more economically. Regardless of whether they are identical or not, one or both R groups, independently, are derived from chemical or natural raw material such as natural oils and fats. In particular, if a natural raw material is used, it means that each group R may have a particular distribution in the length of the carbon chain. Suitably, R is derived from oil or fat of animal or vegetable origin such as tallow, coconut oil and palm oil. Since the preparation of the di-alkyl fatty polyalkylamines according to the invention comprises a hydrogenation step, it may be advantageous, during the process for preparing the products of the invention, to use hydrogenated R groups. Advantageously, the R group is a hydrogenated tallow group. Preferably, the R group of the raw material is unsaturated and is (partially) hydrogenated during the process for preparing the fatty polyalkylamine.

According to a particular embodiment of the invention, when the fatty amine is a mixture of polyalkylamines of formulas (III) and/or (IV), the alkyl R group is obtained from fatty acid chosen from among caprylic acids, pelargonic, capric, undecylenic, lauric, tridecylenic, myristic, pentadecyl, palmitic, margaric, stearic, nonadecylic, arachic, henicosanoic, behenic, tricosanoic, lignoceric, pentacosanoic, cerotic, heptacosanoic, montanic, nonacosanoic, melissic, hentriacontanoic, laceroic, and their derivatives, or unsaturated fatty acids such as palmitoleic acid, oleic acid, erucic acid, nervonic acid, linoleic acid, α-linolenic acid, β-linolenic acid, di-homo-α-linolenic acid, arachidonic acid, eicosapentaenoic acid, docosahexanoic acid, and derivatives thereof.

Preferably, the fatty acids are derived from the hydrolysis of triglycerides present in vegetable and animal oils, such as coconut oil, palm oil, olive oil, peanut oil, rapeseed oil, sunflower oil, soya oil, of cotton, flax, beef tallow. Natural oils may have been genetically modified to enrich their content of certain fatty acids, for example rapeseed oil or oleic sunflower oil.

The di-alkyl fatty polyalkylamine derivative compositions of formulas (III) and/or (IV) according to the invention comprise compounds for which one or more NH fragments of the fatty polyalkylamine of the invention are methylated, alkoxylated, or the two. Such compounds have been found to have advantageous solubility, particularly in lubricating oils. Advantageously, the alkoxylated derivatives are butoxylated, propoxylated and/or ethoxylated. If two or more alkoxylating agents are used, they may be used in any order, for example EO-PO-EO, and the different alkoxy units may be polyhedral in nature and/or randomly present. Advantageously, a primary —$NH_2$ group is alkoxylated with one or more alkylene oxides in a conventional manner to form a —NH-AO—H group, where AO represents one or more alkylene-oxy units. The —NH-AO—H group obtained may be further alkoxylated to form —N(AO—H)$_2$ units. In particular, when large amounts of alkylene oxide (i.e. more than 8 moles of alkylene oxides per mole of polyalkylamine) are used, generally one or more of the secondary amines, if present, are alkoxylated.

According to one embodiment, all the primary and secondary amine functions of the di-alkyl polyamine of formulas (III) and/or (IV) are alkoxylated. According to another embodiment, the di-alkyl fatty polyalkylamines are derived by methylation of one or more NH functions in a manner known to persons skilled in the art, for example by reaction with formic acid and formaldehyde. According to one embodiment, one or more OH functions of the alkoxylated fatty di-alkyl polyalkylamines are conventionally methylated.

However, since it may be more economical to prepare polyalkylamine mixtures of formula (IV), the polyalkylamine mixtures of formula (IV) are preferred. If appropriate, polyalkylamine mixtures of formulas (III) and/or (IV) are used.

The branched polyalkylamines of the invention may be produced by any synthetic route known to persons skilled in the art. A conventional method of production may be from a diamine and involves two or more cycles, preferably two for economic reasons, wherein each cycle comprises a cyanoethylation step and a hydrogenation step. This process is hereinafter referred to as the two-step process. In an alternative process, one equivalent of di-alkyl diamine may react in one step with two or more equivalents of acrylonitrile, followed by hydrogenation. In this case, optional additional cycles involving cyanoethylation and hydrogenation steps may be considered. Such a one-step process may be advantageous since it requires fewer intermediate steps. In order to increase the branching in the two-step process, an acid catalyst is used such as HCl or acetic acid. On the other hand, the increase of the reaction temperature during the cyanoethylation also makes it possible to increase the branching in this process. When carrying out a multi-circle process, the temperature of a subsequent cyanoethylation step is greater than the temperature of a preceding cyanoethylation step, making it possible to obtain a compound with the desired branching. According to one embodiment, more than one mole of acrylonitrile per mole of initial polyamine is used, which also makes it possible to increase the branching of the expected product to the desired level. Suitably, and in order to maintain a homogeneous reaction mixture, a solvent is used. Preferred solvents include $C_{1-4}$ alcohols and $C_{2-4}$ diols. In a preferred manner, ethanol is used because it allows a particular ease of handling. Surprisingly, it has been shown that $C_{1-4}$ alcohols and $C_{2-4}$ diols are not simple solvents but also have a co-catalytic activity during the cyanoethylation step. The amount of solvent employed may vary over a wide range. For economic reasons, the amount employed is preferably minimal. The amount of solvent, particularly in the cyanoethylation step, is preferably less than 50, 40, 30 or 25% by weight based on the liquid reaction mixture. The amount of solvent, in particular in the cyanoethylation step, is preferably greater than 0.1, 0.5, 1, 5 or 10% by weight relative to the liquid reaction mixture.

According to one embodiment, the mixture of di-alkyl fatty polyalkylamines of formulas (III) and/or (IV) according to the invention is characterized by a BN measured according to the ASTM D-2896 standard of between 150 and 350 mg KOH/g of amine, preferably between 170 and 340 and even more preferably between 180 and 320.

According to one embodiment, in the cylinder lubricants according to the invention, the weight percentage of the dialkyl polyalkylamine mixture relative to the total weight of the lubricating composition is chosen so that the BN supplied by these compounds represents a contribution between 5 and 60 mg KOH/g of lubricant, preferably between 10 and 30 mgKOH/g of lubricant, wherein the total BN of the said cylinder lubricant is measured according to ASTM D-2896.

Lubricating Composition

The fatty amine of formula (I), or the mixture of fatty amines of formulas (III) and/or (IV) or the mixture of fatty amines of formulas (I), (III) and/or (IV) according to the invention making it possible to prevent and/or reduce the metallic losses of the parts of an engine, preferably of a marine engine, is present in a lubricating composition. The said lubricating composition comprises:

- at least one base oil, preferably a lubricating base oil for a marine engine,
- at least one detergent based on alkaline or alkaline-earth metals, overbased by metal salts of carbonate.

Preferably, the lubricating composition has a BN determined according to ASTM D-2896 greater than or equal to 15 milligrams of potassium hydroxide per gram of lubricant, more preferably greater than or equal to 40 milligrams.

Advantageously, the lubricating composition has a BN determined according to ASTM D-2896 comprised between 40 and 120 milligrams of potash per gram of lubricant, preferably between 50 and 100 milligrams of potash per gram of lubricant.

Advantageously, the lubricating composition also has a BN determined according to the ASTM D-2896 standard of between 15 and 40 milligrams of potash per gram of lubricant, preferably between 20 and 40 milligrams of potash per gram of lubricant.

According to one embodiment of the invention, the mass percentage of fatty amine relative to the total weight of the cylinder lubricant is chosen so that the BN supplied by this fatty amine represents a contribution of at least 2 milligrams of potassium hydroxide per gram of lubricant to the total BN of the said cylinder lubricant, preferably at least 5 milligrams of potash per gram of lubricant to the total BN of the said cylinder lubricant.

The proportion of BN provided by a fatty amine in the lubricant cylinder according to the invention (in milligrams of potash per gram of finished lubricant, or "points" of BN) is calculated from its intrinsic BN measured according to the ASTM D standard 2896 and its mass percentage in the finished lubricant:

BN amine lub=x. BN amine/100

BN amine lub=contribution of amine to the BN of the finished lubricant x=% mass of the amine in the finished lubricant BN amine=intrinsic BN of the amine alone (ASTM D-2896).

According to one embodiment of the invention, the mass percentage of fatty amine of formulas (I), (III) and/or (IV) relative to the total weight of the cylinder lubricant is chosen so that the BN brought by this fatty amine represents a contribution of 2 to 30 milligrams of potash per gram of lubricant, more preferably 5 to 25 milligrams of potash per gram of lubricant to the total BN of the said lubricant cylinder.

According to a preferred embodiment of the invention, the fatty amine of formula (I) or the mixture of fatty amines of formulas (III) and/or (IV) or the mixture of fatty amines of formulas (I), (III) and/or (IV) is added in an amount of from 0.1 to 15%, preferably from 0.5 to 10%, preferably from 0.5 to 8% or from 3 to 10% by weight relative to the total weight of the lubricating composition.

In another embodiment of the invention, the fatty amine of formula (I) represents from 0.5 to 10%, preferably from 0.5 to 8% by weight relative to the total weight of the lubricating composition.

In another embodiment of the invention, the weight percentage of the polyalkylamine di-alkyl mixture of formulas (III) and/or (IV) relative to the total weight of lubricant is between 0.1 and 15%, preferably between 0.5 and 10%, advantageously between 3 and 10%.

Preferably, the lubricating composition further comprises at least one neutral detergent.

As for the detergents used in the lubricating compositions according to the present invention, these are well known to persons skilled in the art.

According to a particular embodiment of the invention, the detergents commonly used in the formulation of lubricating compositions are typically anionic compounds comprising a long lipophilic hydrocarbon chain and a hydrophilic head. The associated cation is typically a metal cation of an alkali metal or alkaline earth metal.

The detergents are preferably chosen from alkali metal or alkaline earth metal salts of carboxylic acids, sulphonates, salicylates and naphthenates, as well as the salts of phenates.

The alkaline and alkaline earth metals are preferably calcium, magnesium, sodium or barium.

These metal salts may contain the metal in an approximately stoichiometric amount. In this case, we speak of non-overbased or "neutral" detergents, although they also bring a certain basicity. These "neutral" detergents typically have a BN, measured according to ASTM D2896, less than 150 mg KOH/g, or less than 100, or even less than 80 mg KOH/g.

This type of so-called neutral detergent may contribute in part to the BN lubricants according to the present invention. For example, neutral detergents of carboxylates, sulphonates, salicylates, phenates, alkali metal and alkaline earth metal naphthenates, for example calcium, sodium, magnesium or barium, will be used.

When the metal is in excess (in an amount greater than the stoichiometric amount), we are dealing with so-called overbased detergents. Their BN is high, greater than 150 mg KOH/g, typically between 200 and 700 mg KOH/g, generally between 250 and 450 mg KOH/g.

The excess metal providing the overbased detergent character is in the form of metal salts insoluble in oil, for example carbonate, hydroxide, oxalate, acetate, glutamate, preferably carbonate.

In the same overbased detergent, the metals of these insoluble salts may be the same as those of oil-soluble detergents or may be different. They are preferably selected from calcium, magnesium, sodium or barium.

The overbased detergents are thus in the form of micelles composed of insoluble metal salts maintained in suspension in the lubricating composition by the detergents in the form of oil-soluble metal salts.

These micelles may contain one or more types of insoluble metal salts, stabilized by one or more detergent types.

Overbased detergents having a single type of detergent-soluble metal salt will generally be named after the nature of the hydrophobic chain of the latter detergent.

Thus, they will be called carboxylate, phenate, salicylate, sulfonate, naphthenate depending on whether the detergent is a carboxylate, phenate, salicylate, sulfonate, or naphthenate, respectively.

The overbased detergents will be said to be of mixed type if the micelles comprise several types of detergents, different from each other by the nature of their hydrophobic chain.

For use in the lubricating compositions according to the present invention, the oil-soluble metal salts will preferably be carboxylates, phenates, sulphonates, salicylates, and mixed detergents phenate-sulphonate and/or salicylates of calcium, magnesium, sodium or barium.

The insoluble metal salts providing the overbased character are alkali and alkaline earth metal carbonates, preferentially calcium carbonate.

The overbased detergents used in the lubricating compositions according to the present invention are preferably carboxylates, phenates, sulphonates, salicylates and mixed detergents phenates-sulphonates-salicylates, overbased with calcium carbonate.

According to one particular embodiment of the invention, the base oil included in the lubricating composition is selected from mineral, synthetic or vegetable oils, and mixtures thereof.

The mineral or synthetic oils generally used in the application belong to one of the classes defined in the API classification as summarized in the table below.

| | Saturated content | Sulfur content | Viscosity index |
|---|---|---|---|
| Group 1 Mineral oils | <90% | >0.03% | 80 ≤ VI < 120 |
| Group 2 hydrocracked oils | ≥90% | ≤0.03% | 80 ≤ VI < 120 |
| Group 3 Hydroisomerized oils | ≥90% | ≤0.03% | ≥120 |
| Group 4 | PAO | | |
| Group 5 | Other bases not included in groups 1 to 4 | | |

The Group 1 mineral oils may be obtained by distillation of selected naphthenic or paraffinic crudes and then purification of these distillates by processes such as solvent extraction, solvent or catalytic dewaxing, hydrotreating or hydrogenation.

The oils of Groups 2 and 3 are obtained by more severe purification processes, for example a combination of hydrotreatment, hydrocracking, hydrogenation and catalytic dewaxing.

Examples of synthetic bases of Group 4 and 5 include poly-alpha olefins, polybutenes, polyisobutenes, alkylbenzenes.

These base oils may be used alone or as a mixture. A mineral oil may be combined with a synthetic oil.

Cylinder oils for 2-stroke marine diesel engines have a SAE-40 to SAE-60 viscometric grade, typically SAE-50 equivalent with a kinematic viscosity at 100° C. of 16.3 to 21.9 $mm^2/s$.

Grade 40 oils have a kinematic viscosity at 100° C. of between 12.5 and 16.3 $mm^2/s$.

Grade 50 oils have a kinematic viscosity at 100° C. of between 16.3 and 21.9 $mm^2/s$.

Grade 60 oils have a kinematic viscosity at 100° C. of between 21.9 and 26.1 $mm^2/s$.

According to the custom of the profession, it is preferred to formulate cylinder oils for marine 2-stroke diesel engines having a kinematic viscosity at 100° C. of between 18 and 21.5, preferably between 19 and 21.5 $mm^2/s$.

This viscosity may be obtained by mixing additives and base oils, for example containing Group 1 mineral bases such as Neutral Solvent (for example 500 NS or 600 NS) and Brightstock bases. Any other combination of mineral, synthetic or vegetable bases having, in admixture with the additives, a viscosity compatible with the grade SAE-50 may be used.

Typically, a conventional cylinder lubricant formulation for slow 2-cycle marine diesel engines is SAE-40 to SAE-60, preferably SAE-50 (J300 according to the SAE classification) and includes at least 50% by weight of original lubricating base oil. mineral and/or synthetic, suitable for use in a marine engine, for example API class 1, i.e. obtained by distillation of selected crudes and purification of these distillates by processes such as solvent extraction, solvent or catalytic dewaxing, hydrotreatment or hydrogenation. Their viscosity Index (VI) is between 80 and 120; their sulfur content is greater than 0.03% and their saturated content is less than 90%.

According to a particular embodiment of the invention, the lubricating composition may further comprise one or more thickening additives whose role is to increase the viscosity of the composition, hot or cold, or by improving additives of viscosity index (VI).

Preferably, these additives are most often polymers of low molecular weight, of the order of 2000 to 50 000 dalton (Mn).

They may be chosen from PIBs (of the order of 2000 daltons), polyacrylate or poly methacrylates (of the order of 30000 daltons), olefin-copolymers, olefin and alpha olefin copolymers, EPDM, polybutenes, poly-alphaolefins with a high molecular weight (viscosity 100° C.>150), styrene-olefin copolymers, whether or not hydrogenated.

According to a particular embodiment of the invention, the base oil(s) included in the lubricating composition according to the invention may be partially or totally substituted by these additives.

As a result, the polymers used to partially or totally substitute one or more of the base oils are preferably the aforementioned thickeners of the PIB type (for example marketed under the name Indopol H2100).

According to a particular embodiment of the invention, the lubricating composition may further comprise at least one antiwear additive.

Preferably, the anti-wear additive is zinc di-thiophosphate or DTPZn. This category also contains various phosphorus, sulfur, nitrogen, chlorine and boron compounds.

There is a wide variety of anti-wear additives, but the most used category is that of phospho-sulfur-containing additives such as metal alkylthiophosphates, in particular zinc alkylthiophosphates, and more specifically zinc dialkyldithiophosphates or DTPZn.

Amine phosphates, polysulfides, especially sulfur-containing olefins, are also commonly used antiwear additives.

Lubricating compositions containing nitrogen-containing and sulfur-containing anti-wear and extreme pressure additives, such as, for example, metal dithiocarbamates, in particular molybdenum dithiocarbamate, are also usually encountered in lubricating compositions. Glycerol esters are also anti-wear additives. Mention may be made, for example, of mono, di and trioleate, monopalmitates and monomyristates.

According to a particular embodiment of the invention, the lubricating composition may further comprise at least one dispersant.

Dispersants are well known additives used in the formulation of lubricating compositions, especially for application in the marine field. Their primary role is to maintain in suspension the particles present initially or appearing in the lubricating composition during its use in the engine. They prevent their agglomeration by playing on steric hindrance. They may also have a synergistic effect on the neutralization.

The dispersants used as lubricant additives typically contain a polar group, associated with a relatively long hydrocarbon chain, generally containing from 50 to 400 carbon atoms. The polar group typically contains at least one nitrogen, oxygen or phosphorus element.

The compounds derived from succinic acid are dispersants particularly used as lubrication additives. Especially succinimides, obtained by condensation of succinic anhydrides and amines, succinic esters obtained by condensation of succinic anhydrides and alcohols or polyols.

These compounds may then be treated with various compounds including sulfur, oxygen, formaldehyde, carboxylic acids and compounds containing boron or zinc to produce, for example, borated succinimides or zinc-blocked succinimides.

Mannich bases, obtained by polycondensation of phenols substituted with alkyl groups, formaldehyde and primary or secondary amines, are also compounds used as dispersants in lubricants.

It is possible to use a dispersant in the family of succinimide PIBs, for example borated or blocked with zinc.

According to one particular embodiment of the invention, the lubricating composition may furthermore comprise all types of functional additives adapted to their use, for example anti-foam additives to counteract the effect of detergents, which may for example be polar polymers such as polymethylsiloxanes, polyacrylates, anti-oxidant and/or anti-rust additives, for example metal organo-detergents or thiadiazoles. These are known to persons skilled in the art.

According to the present invention, the compositions of the lubricants described refer to the compounds taken separately before mixing, it being understood that the said compounds may or may not retain the same chemical form before and after mixing. Preferably, the lubricants according to the present invention obtained by mixing the compounds taken separately are not in the form of emulsion or microemulsion.

Engine

The use of one or more fatty amines of formulas (I), (III) and/or (IV) according to the invention that are soluble in a lubricating composition makes it possible to prevent and/or reduce the metallic losses of the parts of an engine.

According to a particular embodiment of the invention, the use of one or more fatty amine compounds (I), (III) and/or (IV) makes it possible to prevent and/or reduce the metallic losses of parts in a 2-stroke or 4-stroke marine engine when burning any type of fuel oil.

According to one particular embodiment of the invention, the use of one or more fatty amines of formulas (I), (III) and/or (IV) according to the invention makes it possible to prevent and/or reduce the metallic losses of parts in hot parts, in particular the piston-ring jacket, of a 2-stroke or 4-stroke marine engine, during the combustion of any type of fuel oil.

According to one particular embodiment of the invention, the fuel oil has a sulfur content of less than 3.5% by weight relative to the total weight of the fuel oil.

The various embodiments, variants, preferences and advantages described above may be taken separately or in combination for the implementation of the first subject of the invention.

Process

Another object of the invention covers a method for preventing and/or reducing the metallic losses of the parts of an engine, preferably of a marine engine in which the said parts are brought into contact with one or more soluble fatty amines in a lubricating composition, the fatty amine being chosen from among:

the compounds of formula (I):

$$R_1—[(NR_2)—R_3]_m—NR_4R_5,$$

in which, $R_1$ represents a saturated or unsaturated hydrocarbon group, linear or branched, comprising at least 12 carbon atoms, and optionally at least one heteroatom chosen from among nitrogen, sulfur or oxygen, $R_2$, $R_4$ or $R_5$ independently represent a hydrogen atom or a saturated or unsaturated hydrocarbon group, linear or branched, and optionally comprising at least one heteroatom chosen from among nitrogen, sulfur or oxygen, $R_3$ represents a saturated or unsaturated hydrocarbon group, linear or branched, comprising one or more carbon atoms and optionally comprising at least one heteroatom selected from among nitrogen, sulfur or oxygen, preferably oxygen;

m is an integer greater than or equal to 1, preferably between 1 and 10, more preferably between 1 and 6, even more preferably chosen from 1, 2 or 3, a mixture of fatty polyalkylamines comprising one or more polyalkylamines of formulas (III) and/or (IV):

(III)

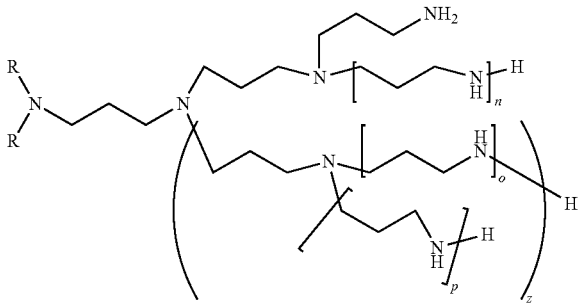

(IV)

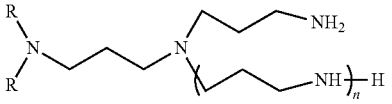

in which

R, identical or different, represents a linear or branched alkyl group comprising from 8 to 22 carbon atoms, n and z, independently of each other, represent 0, 1, 2 or 3, and represent 0, 1, 2 or 3 independently of each other, when z is greater than 0, o and p, wherein the said mixture comprises at least 3% by weight of branched compounds so that at least one of n or z is greater than or equal to 1, or of their derivatives, and a mixture of fatty amines of formulas (I), (III) and/or (IV).

The various embodiments, preferences, advantages, variants described above covering the use of one or more soluble fatty amines in a lubricating composition for preventing and/or reducing the metallic losses of the parts of an engine, preferably a marine engine, apply separately from or in combination with the second object of the invention covering the method described above.

The invention is illustrated by the following examples given without limitation.

Experimental Protocol for Measurement of Metal Part Losses 200 g of the lubricating composition comprising one or more fatty amines according to the invention are introduced into a 700 ml test tube and the test piece is heated at 60° C. with vigorous stirring for a period of approximately 30 minutes.

A cast iron plate, previously sanded, cleaned and weighed, is immersed in the test tube thus heated and agitated, then a quantity of sulfuric acid diluted to 50% is gradually added for 1 h 30 in order to neutralize all or part of the total BN of the said lubricating composition. The amount of 50% diluted sulfuric acid added to the lubricating composition is calculated as a function of the number of BN points to be neutralized. The rate of addition of sulfuric acid diluted to 50% is calculated as a function of the total amount of sulfuric acid to be added over a period of 1 h 30.

The lubricating composition thus acidified and comprising the plate is subsequently stirred for an additional 30 minutes to ensure that the neutralization reaction of the BN is complete.

The plate immersed in the acidified lubricating composition is then removed from the test tube and weighed to determine the metal losses of the said cast iron plate due to the attack of sulfuric acid.

EXAMPLE

Evaluation of Metallic Losses of a Metal Part Placed in Contact with the Fatty Amines According to the Invention and with Sulfuric Acid It is a question of evaluating the metallic losses of a metal part directly put in contact with sulfuric acid and with fatty amines according to the invention contained in a lubricating composition.

For this, various lubricating compositions have been prepared from the following compounds:

a lubricating base oil comprising a mixture of mineral oils of group I and/or II, in particular Brightstock type oils, a detergent package, a mixture of fatty amines 1 comprising predominantly polyalkylamines of formulas (III) and/or (IV), a fatty amine 2 comprising predominantly tetramines of formula (I), a fatty amine 3 comprising predominantly diamines of formula (I), a fatty amine 4 comprising predominantly triamines of formula (I), a fatty amine 5 comprising predominantly tetramines of formula (I).

Compositions $L_1$ to $L_7$ according to the invention are described in Table I as well as a control lubricating composition $L_8$ comprising only a base oil and a detergent package; the percentages given correspond to mass percentages.

TABLE I

| | Compositions | | | | | | | | | | |
|---|---|---|---|---|---|---|---|---|---|---|---|
| | $L_1$ | $L_2$ | $L_3$ | $L_4$ | $L_5$ | $L_6$ | $L_7$ | $L_8$ (control) | $L_9$ | $L_{10}$ | $L_{11}$ |
| Base oil | 74.5 | 76 | 67.7 | 63.9 | 68.7 | 60.1 | 60.3 | 63 | 68 | 69 | 69.5 |
| Detergent package | 22.1 | 20.6 | 26.8 | 28.6 | 26.7 | 35 | 34.8 | 37 | 26.8 | 26.8 | 26.8 |
| Fatty amine 1 | — | — | 5.5 | 7.5 | 4.6 | 4.9 | 4.9 | — | — | — | — |
| Fatty amine 2 | 3.4 | 3.4 | — | — | — | — | — | — | — | — | — |
| Fatty amine 3 | — | — | — | — | — | — | — | — | 5.2 | — | — |
| Fatty amine 4 | — | — | — | — | — | — | — | — | — | 4.2 | — |
| Fatty amine 5 | — | — | — | — | — | — | — | — | — | — | 3.7 |

The results obtained concerning the metallic losses of the parts brought into contact with sulfuric acid and respectively with the lubricating compositions $L_1$ to $L_8$ are described in Table II.

TABLE II

| | Compositions | | | | | | | | | | |
|---|---|---|---|---|---|---|---|---|---|---|---|
| | $L_1$ | $L_2$ | $L_3$ | $L_4$ | $L_5$ | $L_6$ | $L_7$ | $L_8$ (control) | $L_9$ | $L_{10}$ | $L_{11}$ |
| Metallic losses (mg) | 1.8 | 1.4 | 1.55 | 0.15 | 0 | 0 | 0.55 | 89 | 1 | 2.8 | 3.3 |

It is observed that the presence of fatty amines according to the invention contained in the compositions $L_1$ to $L_7$ and $L_9$ to $L_{11}$ makes it possible to significantly reduce, or even to avoid, the metallic losses of a part directly put in contact with sulfuric acid, independently of the content of fatty amines in the lubricating composition, unlike the control composition which does not comprise fatty amines according to the invention. In particular, the metallic losses of the parts do not exceed 4 mg when these parts are immersed in an acidic medium and respectively in the presence of different types of fatty amines according to the invention contained in the lubricating compositions, unlike the metallic losses of the parts in contact with sulfuric acid and a lubricating composition not comprising fatty amines according to the invention which exceed 80 mg.

It is also a question of evaluating the metallic losses of a metal part directly put in contact with fatty amines according to the invention contained in a lubricating composition and with a large excess of sulfuric acid in order to demonstrate that the reduction of metal losses under such conditions is not due to the neutralization of sulfuric acid by the said fatty amines but comes from the passivation of all or part of the surface of the metal parts by the said fatty amines.

For this, two metal parts were respectively immersed in lubricating compositions $L_4$ and $L_8$ in the presence of a large excess of sulfuric acid. The results obtained concerning the metallic losses of the parts brought into contact with a large excess of sulfuric acid and respectively with the lubricating compositions $L_4$ and $L_8$ are described in Table III.

The test making it possible to evaluate the metallic losses of a metal part directly put in contact with fatty amines according to the invention contained in a lubricating composition and with a large excess of sulfuric acid, was carried out according to the experimental protocol for the measurements of metallic losses of metal parts described above. In this test, the amount of sulfuric acid diluted to 50% introduced into the lubricating composition according to the invention was calculated so as to neutralize 150% of the total BN of the lubricating composition according to Table III

| Compositions | $L_4$ | $L_8$ (control) |
|---|---|---|
| Metallic losses (mg) | 7 | 117.7 |

It is observed that even in the presence of a large excess of sulfuric acid, the metal part loses little material, i.e. it loses 7 mg when in contact with fatty amines according to the invention contained in a lubricating composition, unlike a metal part placed in contact with a lubricating composition not comprising fatty amines according to the invention for which the metal losses rise above 115 mg.

Therefore, it has been clearly demonstrated that the use of at least one fatty amine and/or fatty amine derivative contained in a lubricating composition makes it possible to reduce significantly, or even to avoid, the metallic losses of a part of an engine, especially a marine engine, when it is in contact with an acid medium.

What is claimed is:

1. A method of passivation of all or a part of a surface of metal parts of an engine, and of prevention and/or reduction of metallic losses of parts of an engine, comprising a step of applying on said parts of the engine a lubricating composition comprising one or more soluble fatty amines, wherein the fatty amine comprises:

a mixture of one or more polyalkylamines of formulas (III) and/or (IV):

(III)

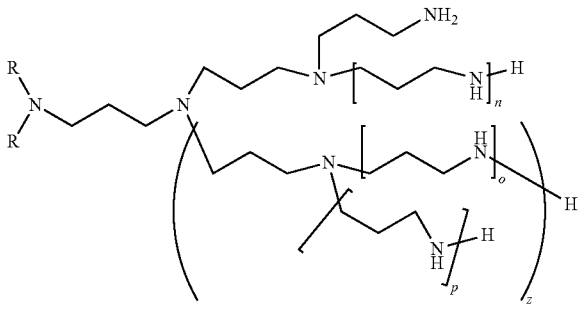

(IV)

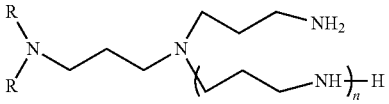

in which

R, identical or different, represents a linear or branched alkyl group comprising from 8 to 22 carbon atoms, n and z, independently of each other, represent 0, 1, 2 or 3, and o and p represent 0, 1, 2 or 3 independently of each other when z is greater than 0, wherein the said mixture comprises at least 3% by weight of branched compounds, or derivatives thereof.

2. The method according to claim 1, wherein the mixture of polyalkylamines of formulas (III) and/or (IV) comprises at least 5% by weight of compounds having a pure linear structure.

3. The method according to claim 1, wherein the polyalkylamine mixture of formulas (III) and/or (IV) comprises at least 4% by weight of branched compounds so that at least n or z is greater than or equal to 1.

4. The method according to claim 1, wherein the polyalkylamine mixture of formulas (III) and/or (IV) comprises at least polyalkylamines of formulas (III) and/or (IV) so that when n, o, p and z are not equal to 0, they are equal to 1 or 2.

5. The method according to claim 1, wherein the polyalkylamine mixture of formulas (III) and/or (IV) comprises at least polyalkylamines of formulas (III) and/or (IV) for which n, o, p or z are independently 0, 1 or 2.

6. The method according to claim 1, wherein the polyalkylamine mixture of formulas (III) and/or (IV) comprises at least polyalkylamines of formulas (III) and/or (IV) and their derivatives for which n, o, p or z independently represent 0, 1 or 2.

7. The method according to claim 1, wherein the mixture of fatty amines of formulas (III) and/or (IV) represents from 0.1 to 15% by weight relative to the total weight of the lubricating composition.

8. The method according to claim 1, for preventing and/or reducing metal losses of parts in a 2-stroke or 4-stroke marine engine, during the combustion of any type of fuel.

9. The method according to claim 1, for preventing and/or reducing metal losses of parts in hot parts, including the piston-ring jacket zone, of a 2-stroke or 4-stroke marine engine, during the combustion of any type of fuel.

10. The method according to claim 1, wherein the fuel oil has a sulfur content of less than 3.5% by weight relative to the total weight of the fuel oil.

* * * * *